US007971745B2

(12) United States Patent
Weiss et al.

(10) Patent No.: US 7,971,745 B2
(45) Date of Patent: Jul. 5, 2011

(54) SMOKER'S STATION

(75) Inventors: Richard E. Weiss, Allentown, PA (US); Barbara McLaughlin, Beverly, MA (US)

(73) Assignee: United Metal Receptable Corp., Pottsville, PA (US)

( * ) Notice: Subject to any disclaimer, the term of this patent is extended or adjusted under 35 U.S.C. 154(b) by 1018 days.

(21) Appl. No.: 10/985,092

(22) Filed: Nov. 10, 2004

(65) Prior Publication Data

US 2006/0096992 A1 May 11, 2006

(51) Int. Cl.
*B65F 1/08* (2006.01)

(52) U.S. Cl. ..... 220/576

(58) Field of Classification Search ..... 220/23.83, 220/23.86, 88.1, 560.01, 576, 908; 206/503; 232/43.2

See application file for complete search history.

(56) References Cited

U.S. PATENT DOCUMENTS

| | | | | |
|---|---|---|---|---|
| 1,531,248 | A | 3/1925 | Anderson | |
| 1,569,603 | A | 1/1926 | Anderson | |
| 1,681,025 | A | 8/1928 | Bradnack | |
| D82,929 | S | 12/1930 | Carpenter | |
| 2,549,114 | A * | 4/1951 | Mosher et al. | 232/43.2 |
| D238,587 | S | 1/1976 | Howell | |
| D428,192 | S | 7/2000 | Meyer | |
| 6,102,047 | A | 8/2000 | Manderick | |
| D452,929 | S | 1/2002 | Perelli | |
| 6,454,122 | B1 | 9/2002 | Luedecke | |
| 6,626,322 | B1 | 9/2003 | Carter et al. | |
| 6,776,167 | B1 | 8/2004 | Gillispie | |
| 7,055,714 | B2 * | 6/2006 | Perelli et al. | 220/576 |
| 7,171,968 | B1 * | 2/2007 | Olson | 131/235.1 |

* cited by examiner

*Primary Examiner* — Anthony D Stashick
*Assistant Examiner* — Harry A Grosso
(74) *Attorney, Agent, or Firm* — Dennis J. Williamson; Moore & Van Allen, PLLC

(57) ABSTRACT

A disposal unit for discarded smoking products has, a lower tubular section mounted on a base, an upper tubular section with an interior partition to form a closed-bottom receptacle for the discarded smoking products, a removable cap covering an open end of the upper tubular section, and the cap and tubular sections are detachable from one another for emptying the receptacle.

10 Claims, 7 Drawing Sheets

SMOKER'S STATION

FIELD OF THE INVENTION

The present invention relates to a disposal unit for discarded smoking products, wherein the disposal unit is placed at a location where smoking is permitted.

BACKGROUND

Persons are prohibited from smoking in buildings and in other public spaces to comply with health and fire safety concerns. Smokers must extinguish and discard their smoking products before entering such public spaces. Further, most public spaces accommodate smokers by providing designated public areas where smoking is permitted. Receptacles are provided in these areas to collect discarded smoking products. In the past, such receptacles have been in the form of ash trays filled with sand to snuff-out lit cigarettes and cigars. However, the ash trays often collected paper scraps and other flammable refuse, which heightened fire safety concerns. Further, the ash trays often spilled their contents, particularly while being emptied by persons performing routine maintenance. The ash trays that were exposed to the outdoors would be soaked with rain, making routine maintenance more difficult. Further, the ash trays exposed to the outdoors were damaged and tipped over by the wind.

Each of U.S. Pat. Nos. 6,454,122 and 6,626,322 discloses a refuse receptacle for discarded smoking products, according to which an enlarged chamber contains a collection bucket that can be emptied. A bonnet shields the collection chamber from rain. The collection chamber is molded with a complex shape to form a hooded cranny surrounding an opening that receives discarded smoking products. However, the complex shape adds unnecessary manufacturing cost.

Each of, U.S. Pat. Nos. 1,531,248 and 1,569,603 and 1,681,025, discloses an enlarged ash tray that funnels discarded smoking products into a closed-bottom collection tube. The ash tray and the collection tube are detachable, to remove and empty the tube when filled with discarded smoking products. In each of U.S. Pat. Nos. 1,569,603 and 1,681,025, the tube is removed from an exterior sleeve that concentrically surrounds the entire length of the collection tube. The enlarged ash tray is easily tipped over in the wind, and would tend to collect flammable refuse when placed in a public area.

U.S. Pat. No. 6,776,167 discloses a refuse collection device that is fabricated by molding as few parts as possible to reduce packaging, storing and shipping costs. However, the collection device has a wide area receptacle, combined with an elongated slender section, which are shapes that are difficult to package with a simple packaging shape. Further, a slender streamlined design was not attainable by having a wide area receptacle.

Each of U.S. Design Pat. No. D428,192 and U.S. Design Pat. No. D82,929 S discloses a collection device with a monolithic exterior shape.

A disadvantage of a prior collection device is that a receptacle for collecting discarded smoking products is at ground level or floor level. Thus, a person performing routing maintenance must bend over one's self to remove the receptacle from the collection device and to empty the contents of the receptacle. Further, when the receptacle is not capable of disassembly from other parts of the collection device, the other parts add awkwardness and difficulty to the task of emptying the collection device. Further, a receptacle at ground level is difficult to re-assemble with the collection device, and is difficult to visually inspect without bending over one's self.

A desirable disposal unit for discarded smoking products would be shielded from the weather, and would have a substantially closed collection receptacle that is easily emptied. Further, the desired disposal unit would have a low cost, standardized construction, and would be easy to assemble and disassemble for routine maintenance, packaging and shipping. Further, a sleek and slender architectural profile is desired for a disposal unit on public display.

SUMMARY OF THE INVENTION

According to the invention, a disposal unit for discarded smoking products has a tubular extension extending from a base, and the tubular extension is divided into tubular sections. A partition is inside an upper tubular section to form a closed-bottom receptacle for the discarded smoking products. One or more closed end slots provide corresponding one or more inlets of the receptacle, wherein a corresponding tubular side wall of the upper tubular section comprises a periphery of each of the one or more closed end slots. A removable cap covers an open end of the upper tubular section, and the cap and tubular sections are detachable from one another for emptying the receptacle.

Advantageously the invention is fabricated from commercially available, metal tubes, which have standard dimensions and surface finishes. Thus the disposal unit according to the invention can be manufactured at low cost from industry standard products.

Further, all hardware parts of a disposal unit according to the present invention are installed inside the tubular sections, such that the tubular sections themselves advantageously form a sleek and slender exterior of the disposal unit.

According to an embodiment of the invention, the upper tubular section assembles to another tubular section by encircling a coupling tube section that fits within an internal circumference of the corresponding side wall of the upper tubular section, and the coupling tube section detachably fits inside the upper tubular section. The coupling tube section itself is commercially available as industry standard stock product that is cut to desired length to form the coupling tube section.

According to another embodiment of the invention, a closed-bottom receptacle for discarded smoking products is fabricated by installing a partition inside a tubular section of a tubular disposal unit. Thus, the receptacle is formed at low cost. Further, the receptacle is an upper tubular section at an elevated, convenient height for grasping and for separating from a lower tubular section, as well as, for re-assembly at the elevated, convenient height after performing routine maintenance. Further, the receptacle bottom is spaced from a floor, such that smoldering or hot smoking products in the receptacle are spaced from the floor to avoid a fire hazard.

According to another embodiment of the invention, the tubular section is cut out with one or more closed end slots to provide one or more inlets to the closed-bottom receptacle, such that each closed end slot is defined, advantageously at low cost, by the corresponding side wall of the tubular section.

According to another embodiment of the invention, a disposal unit for discarded smoking products has a feature to snuff lit smoking products prior to being discarded.

Other embodiments and features of the present invention will become apparent, by way of example, from the following detailed description taken in conjunction with the accompanying drawings.

DETAILED DESCRIPTION

Figure 1:
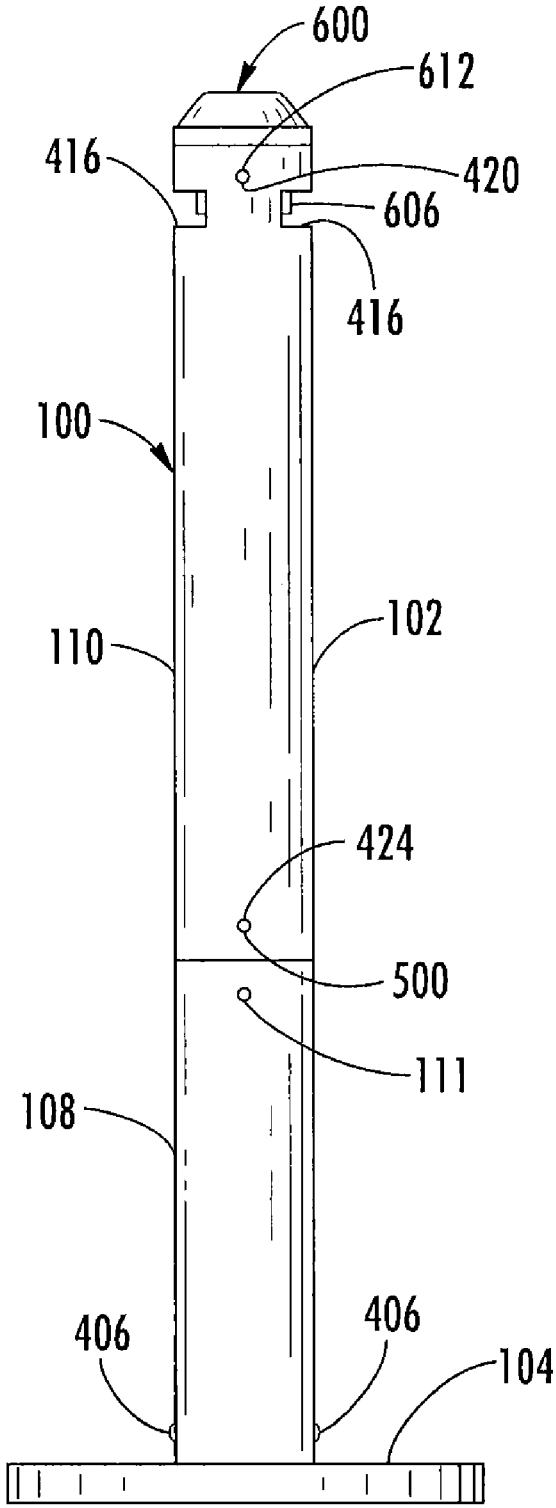
FIG. 1 is a rear view of a disposal unit for discarded smoking products.

This description of the exemplary embodiments is intended to be read in connection with the accompanying drawings, which are to be considered part of the entire written description. In the description, relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

FIG. 1 discloses a disposal unit (100) for discarded smoking products, which includes an upright tubular extension (102) extending from a wide area base (104). The tubular extension (102) is divided into tubular sections, including at least a lower tubular section (108) and an upper tubular section (110). Both are cut to length from standard stock tubes having industry standard dimensions and finishes. All exposed edges are rounded to avoid injury to persons handling the disposal unit (100).

The base (104) is advantageously cut out from commercially available, stock metal plate of standard thickness. Thus, the base (104) is adapted for low cost manufacture.

Figure 3A:
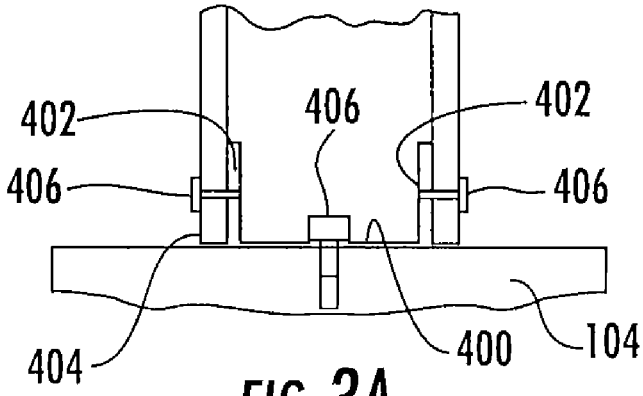
FIG. 3A is an enlarged section view of a portion of FIG. 3.
Figure 3:
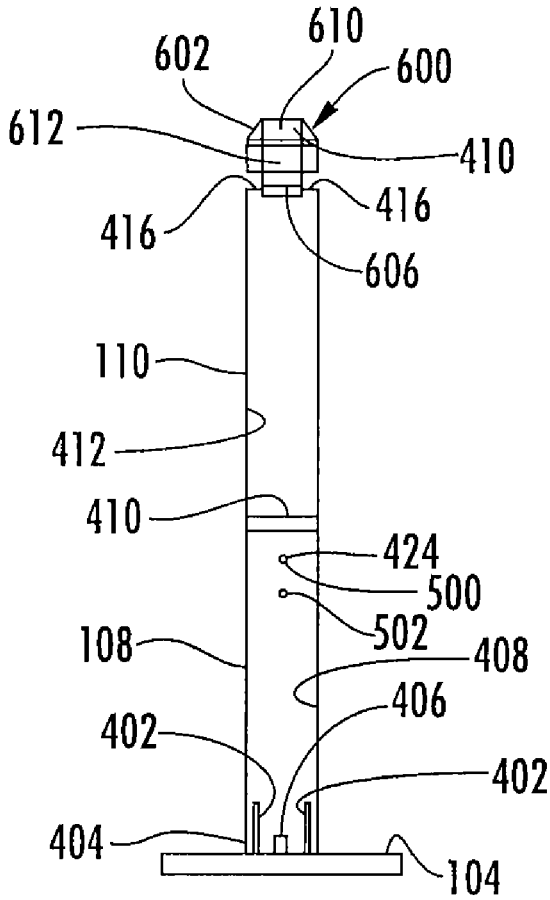
FIG. 3 is a longitudinal section view taken along the longitudinal axis of the disposal unit shown in FIG. 1.
Figure 4:
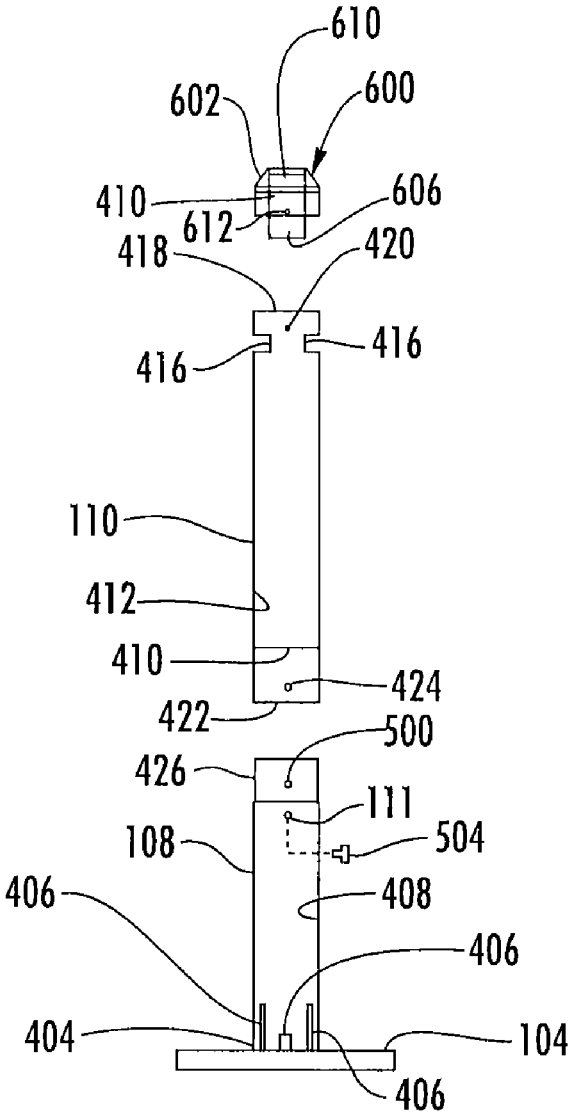
FIG. 4 is a view similar to FIG. 3 with parts disclosed in exploded configuration.

FIGS. 3 and 4 disclose the lower tubular section (108) after one or more fastener-receiving apertures (111) have been drilled through its corresponding side wall. Then, the lower tubular section (108) is assembled to the base (104). A U-shaped bracket (400) formed from inexpensive metal strap is attached to the base (104) by an Allen head screw (106). Alternatively, the bracket (400) is welded to the base (104). The spaced apart bracket arms (402) of the bracket (400) fit inside a lower open end (404) of the lower tubular section (108). Threaded fasteners (406) extend through the corresponding side wall of the lower tubular section (108) and secure to the arms 402) of the bracket (400). The bracket (400) comprises low cost hardware that is advantageously hidden inside the lower tubular section (108). Accordingly, the bracket (400) is adapted for low cost manufacturing. Further, the exterior of the lower tubular section (108) advantageously provides a sleek and slender, exterior profile of the disposal unit (100). The interior of the tubular extension (102) forms a weight-receiving chamber (408) adjacent to the base. A weighted chamber (408) adapts the disposal unit (100) to resist tipping over in the wind when placed outdoors. For example, inexpensive silicon dioxide sand, gravel or other inflammable substance comprises a suitable weight.

Figure 1A:
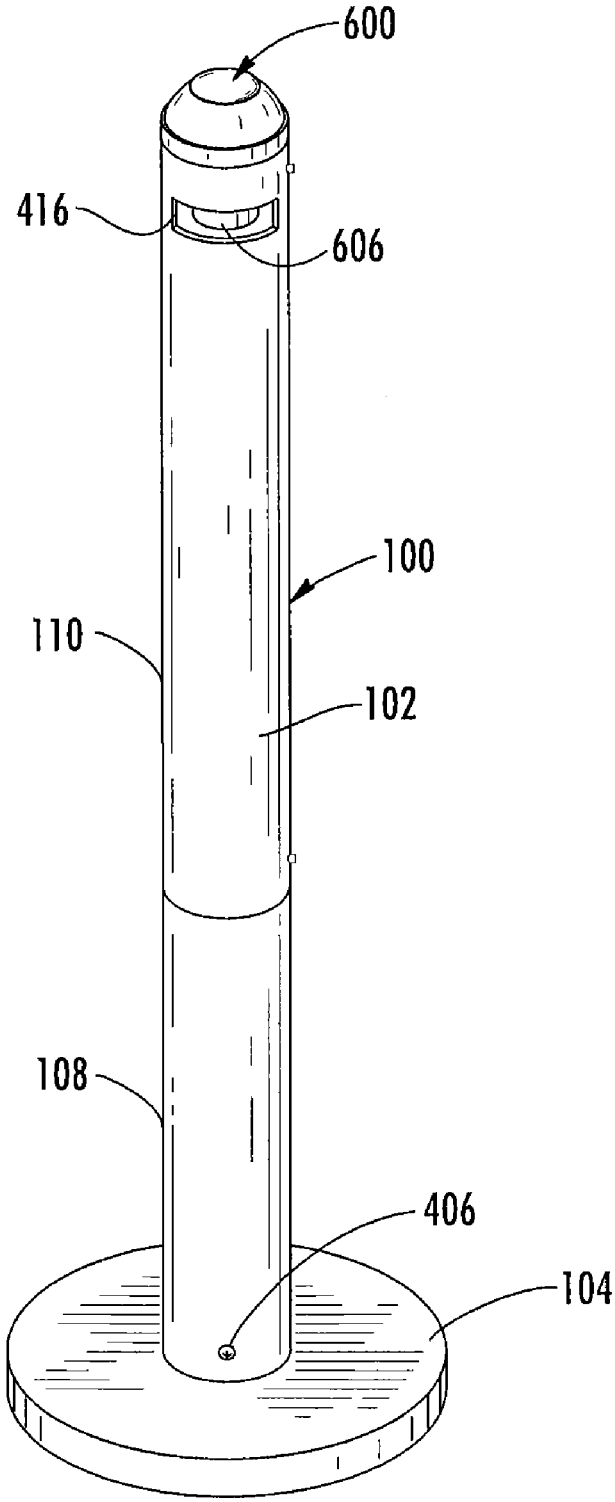
FIG. 1A is an isometric view of the disposal unit disclosed by FIG. 1.
Figure 2:
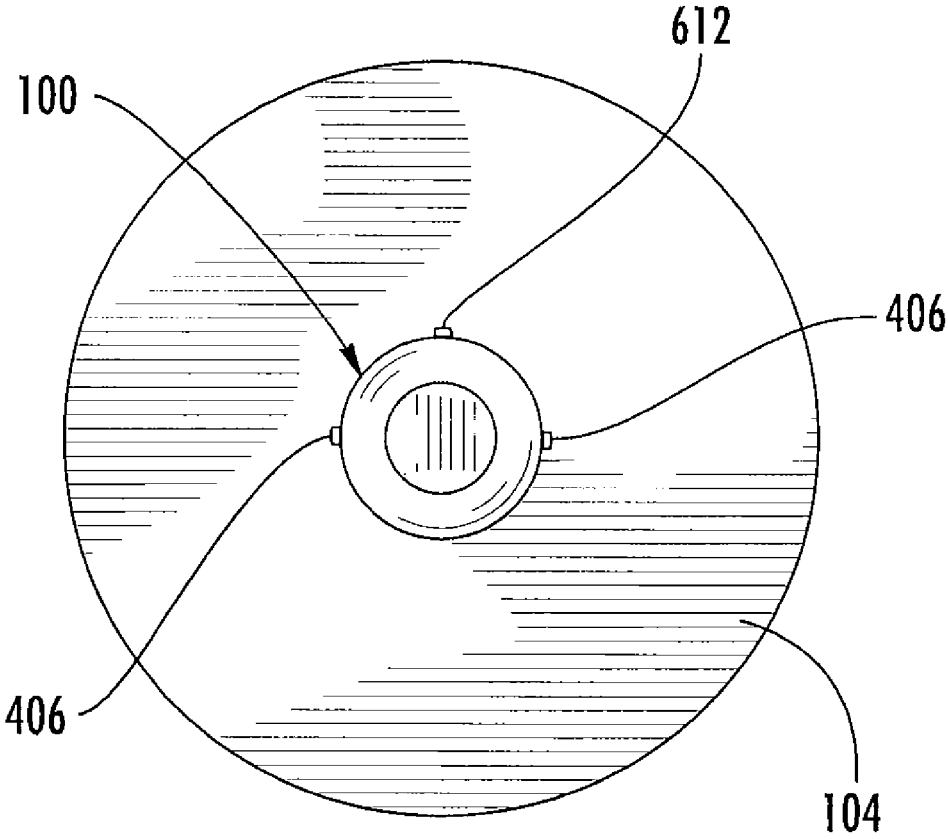
FIG. 2 is a top view of the disposal unit disclosed by FIG. 1.
Figure 4A:
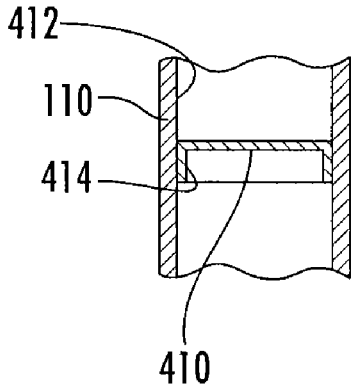
FIG. 4A is an enlarged fragmentary view of a portion of FIG. 4.

FIGS. 4 and 4A disclose that the upper tubular section (110) has a first interior partition (410) to form a closed-bottom receptacle (412) for discarded smoking products. The partition (410) is a simple plate having an upturned flange (414) that is secured against the interior surface of the upper tubular section (110), for example, by welding or by a permanent adhesive. Further, one or more inlets (416) of the receptacle (412) are formed by cutting one or more closed end slots through the corresponding tubular sidewall of the upper tubular section (110). Thereby, the corresponding tubular side wall of the upper tubular section (110) remains unshaped and in its original form to comprise a periphery of each of the one or more closed end slots. For example, as disclosed by FIG. 1A, each of the inlets (416) measure approximately 3.345 inches in width and 1.000 inches in height. For example, the width comprises a chord measured across a circular cross section of the upper tubular section (110). Further, the exterior of the upper tubular section (110) advantageously provides a sleek slender, architectural profile of the disposal unit (100). Further, the inlets (416) are spaced from an upper open end (418) of the upper tubular section (110) to avoid weakening the upper edge of the upper tubular section (110). Near the upper open end (418), one or more detent receiving recesses (420) are formed either by drilling apertures through the sidewall, or by a punching operation to indent the sidewall interior surface. Further, near the bottom end (422) of the upper tubular section (110), one or more additional detent receiving recesses (424) are formed either by drilling apertures through the sidewall, or by a punching operation to indent the sidewall interior surface to form indented recesses (424).

FIG. 4 further discloses the lower tubular section (108) encircling a coupling tube section (426) that project outwardly toward the upper tubular section (110). The upper tubular section (110) assembles to the lower tubular section (108) by encircling and telescoping with the coupling tube section (426). The coupling tube section (426) detachably fits within the corresponding side wall of the upper tubular section (110) to support the upper tubular section (110) in an upright orientation. The partition (410) is spaced above the coupling tube section (426).

The coupling tube section (426) is cut to length from a standard stock tube having standard manufacturing dimensions to fit concentrically within the upper tubular section (110). The standard stock tube assures a low material cost. Alternatively, the coupling tube section (426) can be cut from a flat sheet of metal, and then rolled-up to a tube shape. The length of the coupling tube section (426) is selected to maintain the upper tubular section (110) upright and in abutting, tandem alignment with the lower tubular section (108). After cutting the coupling tube section (426) to a desired length, one or more spring biased, projecting detents (500) are assembled to bulge outwardly of the exterior surface. Further, one or more fastener receiving apertures (502) are drilled through the side wall of the coupling tube section (426). Then, as disclosed by FIG. 4, the coupling tube section (426) is inserted into the lower tubular section (108). Each fastener receiving aperture (502) is aligned with a corresponding aperture (111) through the lower tubular section (108). A fastener (504), for example, a blind rivet, or pop rivet, is installed in each pair of aligned apertures (502) and (111) to secure the coupling tube section (426) to the lower tubular section (108). Alternatively, the coupling tube section (426) is welded to the lower tubular section (108), in substitution for each fastener (504) and the corresponding aligned apertures (502) and (111).

With reference to FIGS. 3 and 4, the upper tubular section (110) is slidably assembled over the coupling tube section (426). The projecting detents (500) slidably engage with a force fit against the internal surface of the upper tubular section (110) until they register with a snap-fit into corresponding detent receiving recesses (420) in the upper tubular section (110). The upper tubular section (110) is adapted to overcome the snap-fit while slidably removing the upper tubular section (110) to empty the receptacle (412).

Figure 6:
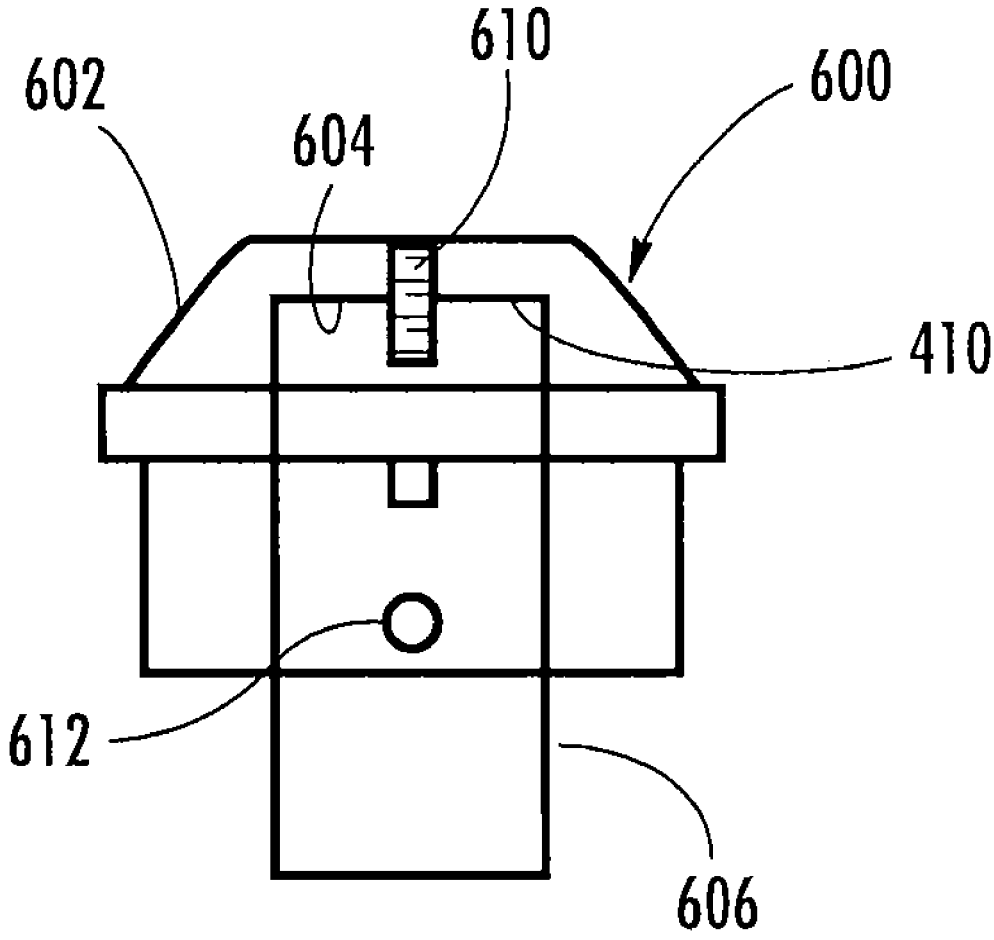
FIG. 6 is an enlarged section view of a removable cap of the disposal unit according to the invention.

FIG. 6 discloses a formed metal cap (600) constructed with a sloped bonnet (602) to bridge across and covers the upper open end (418), shown in FIG. 4, of the upper tubular section (110). The bonnet (602) is sloped, for example, with a dome to promote rain run-off. The bonnet underside (604) is a hollow socket assembled and secured by welding or by an adhesive to an upper end of a second coupling tube section (606) that has been cut to length from a standard stock tube having standard manufacturing dimensions to fit concentrically within the upper tubular section (110). Alternatively, the second coupling tube section (606) can be cut from a flat sheet of metal, and then rolled-up to a tube shape. A second partition (410), similar in construction to the first partition (410), has a flange (414) that is welded or adhesively secured inside, at the top end of, the second coupling tube section (606). A machine screw (610) secures the cap (600) to the second partition (410) of the second coupling tube section (606).

As disclosed by FIG. 3, the second coupling tube section (606) of the cap (600) slidable fits in the open end (418) of the upper tubular section (110). The inlets (416) of the receptacle (412) are below, and spaced from, the second coupling tube section (606). One or more resilient spring biased, projecting detents (612) are assembled to bulge outwardly of the exterior surface of the second coupling tube section (606). When the cap (600) is assembled to the upper tubular section (110), the second coupling tube section (606) is received in the upper open end of the upper tubular section (110). The projecting detents (612) slidably engage with a spring biased, force fit against the internal surface of the upper tubular section (110) until they register with a spring biased, snap-fit into corresponding detent receiving recesses (420) in the inner surface of the upper tubular section (110). Advantageously, the receptacle (412) and the caap (600) have cross section dimensions that are easily grasped by a person performing routine maintenance. For example, the receptacle (412) comprises the upper tubular section (110) of between 3 inches nominal dimension to 4.5 inches nominal dimension at the cross section thereof, for ease in grasping with one hand. Although a round cross section is illustrated in the drawings, an embodiment of the invention may comprise, either round, square or rectangular, standard stock tubing that has such a nominal dimension at the cross section thereof.

Figure 5:
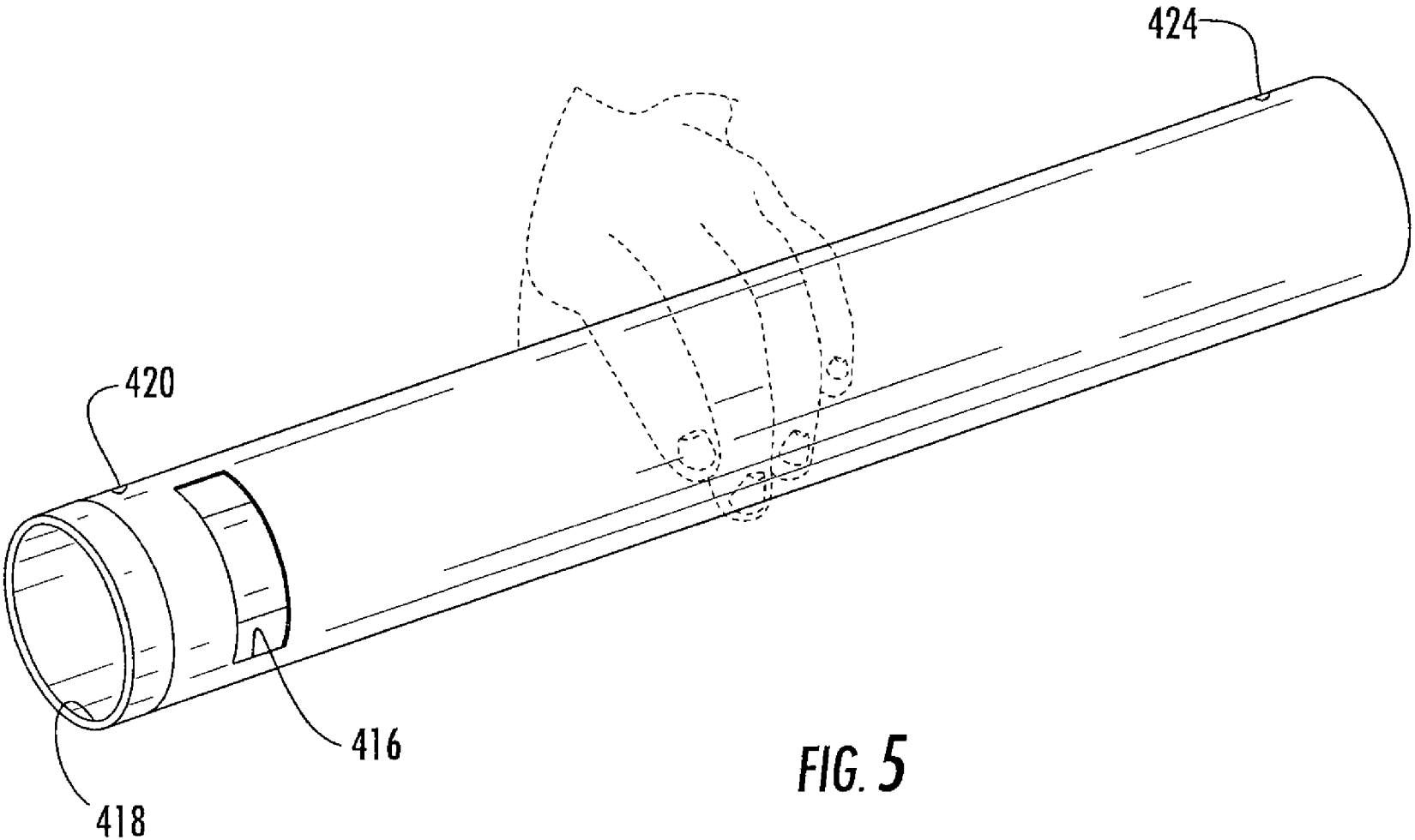
FIG. 5 is an isometric view of a receptacle being emptied during performance of routine maintenance.

FIG. 5 discloses that the circumferences of the upper tubular section (110) and the cap (600) are readily grasped by a person performing routine maintenance. The cap (600) is adapted to overcome the snap-fit while slidably removing the cap (600) from the open end of the upper tubular section (110). After removing the cap (600), the upper tubular section (110) is grasped and slidably disassembled from the lower tubular section (108) to empty the receptacle and perform other tasks of routine maintenance.

Further, the upper tubing section (110) is assembled in the disposal unit (100) at an elevated, convenient height for a person to grasp and disassemble from the lower tubular section (108). Further, the upper tubing section (110) is at an elevated, convenient height for re-assembly in the disposal unit (100) after performing routine maintenance. The upper tubular section (110) and the cap are manually removed and re-assembled in the disposal unit (100) without tools. The upper tubular section (110) and the lower tubular section (108) are disassembled and placed adjacent to one another for compact packaging and shipping.

FIG. 6 discloses a snuff out surface (606) provided by an interior tube section (606) of smaller diameter than that of the upper tubular section (110). For example, the interior tube section (606) is 3 inches nominal outer diameter. A top end of the tube section (606) is received in the underside of the bonnet and is secured by welding or by an adhesive. The bonnet holds the tube section (606) concentrically spaced within the upper tubular section as part of the receptacle. The space is slender to discourage receipt of discarded paper scraps. The interior tube section (606) extends behind each of the one or more inlets (416) of the receptacle (412) to provide an interior snuffing surface behind each of the one or more inlets (416) of the receptacle (412). For example, the interior tube section (606) extends one-eighth inch below the crossing centerlines of each inlet (416). A smoldering smoking product is inserted through one of the inlets (416), and is snuffed out against the interior tube section (606). The smoking product then is discarded and falls in the space between the interior tube section (606) and the interior of the upper tubular section (110), and is collected in the receptacle (412).

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A disposal unit for discarded smoking products comprising:

a tubular extension extending from a wide base, wherein the tubular extension is divided into tubular sections;

an upper tubular section has an interior partition to form a closed-bottom receptacle for the discarded smoking products;

one or more inlets for the receptacle provided by one or more closed end slots, wherein a corresponding tubular side wall of the upper tubular section remains unshaped and in its original form to comprise a periphery of each of the one or more closed end slots;

a removable cap covers an open end of the upper tubular section; and the cap and tubular sections are detachable from one another for emptying the receptacle.

2. The disposal unit of claim 1, wherein the tubular extension is joined to the base by a bracket inside the tubular extension.

3. The disposal unit of claim 1, wherein an interior of the tubular extension forms a weight-receiving chamber adjacent to the base.

4. The disposal unit of claim 1, wherein the upper tubular section assembles to another tubular section by encircling a coupling tube section that fits within an internal circumference of the corresponding side wall of the upper tubular section, and the coupling tube section detachably fits inside the upper tubular section.

5. The disposal unit of claim 1, wherein the partition is a plate having a circumferential flange secured to an internal surface of the corresponding side wall of the upper tubular section.

6. The disposal unit of claim 1, wherein the upper tubular section assembles to another tubular section by encircling a coupling tube section that fits within an internal circumference of the corresponding side wall of the upper tubular section, the coupling tube section detachably fits inside the upper tubular section, and the partition is spaced from the coupling tube section.

7. The disposal unit of claim 1, wherein the removable cap has a coupling tube section that fits within an open end of the corresponding side wall of the upper tubular section, and the inlets are spaced from the open end of the upper tubular section.

8. The disposal unit of claim 1, wherein the removable cap has a bonnet bridging across the open end of the upper tubular section, and the removable cap has a coupling tube section that fits within an internal circumference of the corresponding side wall of the upper tubular section.

9. The disposal unit of claim 1, further comprising:

an interior snuffing surface behind each of the one or more inlets of the receptacle.

10. The disposal unit of claim 1, further comprising:

a tube section of smaller circumference than the upper tubular section, said tube section providing an interior cigarette snuffing surface behind each of the one or more inlets of the receptacle.

* * * * *